US009387599B1

(12) United States Patent
Newman

(10) Patent No.: US 9,387,599 B1
(45) Date of Patent: Jul. 12, 2016

(54) BACKHOE LOG SPLITTER ATTACHMENT TOOL

(76) Inventor: Joseph E. Newman, Bangor, PA (US)

( * ) Notice: Subject to any disclaimer, the term of this patent is extended or adjusted under 35 U.S.C. 154(b) by 1047 days.

(21) Appl. No.: 13/476,635

(22) Filed: May 21, 2012

Related U.S. Application Data

(60) Provisional application No. 61/487,825, filed on May 19, 2011.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
USPC ..... 144/193.1, 193.2, 195.9, 195.8, 195.7, 144/195.6, 195.2
See application file for complete search history.

(56) References Cited

U.S. PATENT DOCUMENTS

| | | | | |
|---|---|---|---|---|
| 3,780,779 | A | 12/1973 | Guy | |
| 4,019,549 | A | 4/1977 | Williams | |
| 4,073,325 | A | 2/1978 | Krom, Jr. | |
| 4,112,985 | A | 9/1978 | Gosselin | |
| 4,155,385 | A | 5/1979 | Lapointe | |
| 4,236,556 | A | 12/1980 | Smith | |
| 4,262,714 | A | 4/1981 | Pratt et al. | |
| 4,340,098 | A | 7/1982 | Scott | |
| 4,380,258 | A | 4/1983 | Hanser | |
| 4,426,782 | A | 1/1984 | Baisden | |
| 4,444,231 | A | 4/1984 | Dillon | |
| 4,453,580 | A | 6/1984 | Patten | |
| 4,600,043 | A | 7/1986 | Chapman | |
| 4,615,367 | A | 10/1986 | Crowley, Jr. | |
| 5,144,995 | A | 9/1992 | Pettersson | |
| 5,320,149 | A | 6/1994 | Peterson et al. | |
| 5,803,141 | A | 9/1998 | Patterson | |
| 6,609,547 | B1 | 8/2003 | Machkovech | |
| 6,763,864 | B2 | 7/2004 | Setlack et al. | |
| 7,066,223 | B2 * | 6/2006 | Stone | B27L 7/00 144/193.2 |
| 2009/0236011 | A1 | 9/2009 | Bolton | |
| 2009/0288737 | A1 | 11/2009 | Gilmet | |

* cited by examiner

*Primary Examiner* — Matthew G Katcoff
(74) *Attorney, Agent, or Firm* — Clinton H. Wilkinson; Charles A. Wilkinson

(57) ABSTRACT

A log splitting attachment tool adapted for use in combination with a material moving machine having a boom and dipper stick for lifting and moving as well as splitting logs which tool can alternatively be secured directly to a dipper stick and hydraulic bucket cylinder or to a quick connect mechanism secured thereto.

13 Claims, 5 Drawing Sheets

BACKHOE LOG SPLITTER ATTACHMENT TOOL

REFERENCE TO RELATED APPLICATION

This application claims the benefit of U.S. Provisional Application 61/487,825 filed on May 19, 2011.

BACKGROUND OF THE INVENTION

1. Field of the Invention

The present invention relates generally to machines and devices for splitting logs into smaller sections, and more particularly to hydraulic log splitting machines and devices, and more particularly still to a log splitter attachment tool for use with mobile machines having a hydraulically powered articulating boom and dipper stick such as a backhoe loader, which attachment tool is alternatively connectable to said mobile machine either directly to the dipper stick and bucket hydraulic curl cylinder or indirectly to a quick connect mechanism.

2. Preliminary Discussion and Prior Art

Various log splitting machines are available commercially for purchase, which in general significantly increase the ease, speed and efficiency of the splitting process in comparison to manual splitting using a conventional axe or the like. However, most of such power-operated log splitters are relatively expensive in that they require an independent framework that is sturdy enough to support a hydraulic system and motor, and that holds the log or wood during cutting, as well as a means for holding and guiding a movable cutting anvil or blade. In addition, most commercially available power-operated log splitters are limited in that they cannot be easily adapted or modified for other uses, and are bulky and difficult to transport and store.

Several log splitter attachments for use with other machines having a hydraulic articulating boom and dipper stick, primarily construction and earthwork machines such as tractors with hydraulically operated front-end loaders, backhoes with hydraulic buckets, or the like, are known, where the force generated by the hydraulic piston or cylinder is utilized to split the logs. The following references are illustrative of such attachment tools and devices:

U.S. Pat. No. 3,780,779 issued to R. J. Guy entitled "Log Splitting Device Adapted to Utilize Powered Piston on Tractor" discloses a log splitter attachment for use with a farm tractor having a hydraulically operated front end loader, wherein the hydraulic piston-cylinder for operating the bucket is detached from the bucket and secured to the splitter attachment, where it is used to urge a log against a splitting wedge. The splitting device in one embodiment has an elongated frame that is connected directly to the tractor frame on one end, and in another embodiment is secured to the end of one of the bucket arms. Logs split using the Guy splitter attachment must be manually loaded on the device.

U.S. Pat. No. 4,019,549 issued to T. V. Williams entitled "Wood Splitting Apparatus" discloses a log splitter attachment for use with a backhoe wherein an I-beam that supports a log splitting assembly including a splitting wedge is pivotably secured on one end to a pivot plate attached to the main boom base, and the other end is supported by a follower yoke secured to the backhoe dipper stick or secondary boom. A log placed on the I-beam is cradled between the wedge and follower yoke, and when the secondary boom is moved toward the main boom the log is forced across the wedge.

U.S. Pat. No. 4,073,325 issued to C. Krom, Jr. entitled "Wood-Splitting Attachment" discloses another wood splitting attachment for use in place of a backhoe bucket assembly, which attachment is secured to the dipper stick and piston and cylinder assembly. The attachment includes an elongated concave trough in which a log is placed and a ground or base plate on which the log is supported, and the piston and cylinder assembly is operated to force a splitting wedge downwardly against the top end of the log to split it.

U.S. Pat. No. 4,112,985 issued to Y. Gosselin entitled "Hydraulic Log Splitter Implement" discloses a log splitting attachment to be connected to the three-point hitch of a tractor. A log to be split must be manually placed standing upright on a log support, and a pivoting wedge secured to the tractor hydraulic piston-cylinder is driven downwardly onto the top end of the log. One advantage is that the tractor can still be used to tow other equipment without removing the log splitting attachment.

U.S. Pat. No. 4,155,385 issued to R. Lapointe entitled "Log-Splitting Device" discloses another log splitting attachment for use with a backhoe having a ground-supported base section on which an upright log is placed, after which similar to the Krom, Jr. attachment a wedge is driven downwardly into the end of the log. Lapointe also discloses a control rod which is attached to the backhoe controls so that the operator can manually load the splitter and then operate the controls without returning to the backhoe cabin.

U.S. Pat. No. 4,236,556 issued to R. C. Smith entitled "Wood Splitter Attachment" discloses another log splitting attachment for use with a backhoe, and more particularly a backhoe having a ground stabilizer and a stabilizer-positioning hydraulic ram, rather than the bucket hydraulics, whereby the attachment is secured to the stabilizer and utilizes the hydraulic ram to drive a wood splitting anvil through the end of a log.

U.S. Pat. No. 4,262,714 issued to G. F. Pratt et al. entitled "Log Splitting Attachment for Tractor Three Point Hitch Members" discloses a log splitting attachment for a tractor, in which as the bars forming the bottom members of a three-point hitch are moved in relation to the upper member, the log is split.

U.S. Pat. No. 4,340,098 issued to G. K. Scott entitled "Log Splitter and Attachment for Tractor", discloses another log splitting attachment for the three-point hitch of a tractor, in which in use a hoist bar forces the log upwardly against a stationary splitting wedge.

U.S. Pat. No. 4,380,258 issued to P. E. Hanser entitled "Log Splitter" discloses a standalone hydraulic log splitter having a hydraulic boom-like arm with a cutting blade on the end of the outer lever arm that can split a log lying on the ground by holding and pushing the log with a lever arm against a stop on the splitter frame.

U.S. Pat. No. 4,426,782 issued to J. Baisden entitled "Attachment for a Backhoe Arm" discloses a backhoe arm attachment capable of various uses, including log-splitting, in which a first portion of the tool is movable with respect to a second portion, and more particularly, a hydraulically operated sliding member pushes a log resting on the sliding member against a wedge to split the log in two.

U.S. Pat. No. 4,444,231 issued to R. L. Dillon entitled "Log Splitter for Backhoe Vehicles" discloses a log splitting attachment for use with a backhoe including a ground platform, a vertical I-beam attached to the platform, means for securing the I-beam to the backhoe secondary or outer boom, and a splitting wedge which is attached to the backhoe hydraulic cylinder and slidable on the I-beam, whereby a log is placed upstanding on the platform, and the backhoe hydraulic cylinder is operated to bring the splitting wedge downwardly against the end of the log.

U.S. Pat. No. 4,453,580 issued to W. J. Patten entitled "Wood Splitting Device" discloses a wood splitting attachment for a backhoe without first requiring that the conventional bucket be completely removed from the dipper stick. The Patten attachment includes a platform with a sliding surface on which a log to be split is placed, which surface is hydraulically moved to urge the log against a splitting wedge on the outer end of the sliding surface. The conventional bucket is secured to the wood splitting attachment in a folded position, and is used to help stabilize the attachment during its use.

U.S. Pat. No. 4,600,043 issued to V. R. Chapman entitled "Log Splitting Apparatus" discloses a backhoe log splitter attachment that can be used to split both long and short logs. A cutting blade is pivotably secured to the end of the dipper stick, and is pivoted by the dipper stick hydraulic ram via another bracket. The blade has a straight cutting edge on one side and a tapered or angled wedge portion on the other side, and also attached extending outwardly from the left side of the dipper stick is a pair of claw arms operated by a separate hydraulic ram. In use, a first log is grasped between the claws and side of the blade, and is positioned crossways against the front of the backhoe tracks. Then, a second log to be cut is positioned perpendicular against the side of the first log, the blade edge is squared to the end of the log, and is forced into the end of the log, with the wedge portion increasing the width of the split.

U.S. Pat. No. 4,615,367 issued to J. C. Crowley, Jr. entitled "Backhoe Log Splitter" discloses another log splitting attachment for use with a backhoe including two wood splitting pincers which are secured to the backhoe dipper stick in place of the conventional bucket. The pincers include a stationary wedge secured to the boom side of the dipper stick, and a pusher device mounted to the bucket pivot and dipper stick piston, whereby logs held between the stationary wedge and pusher are split when the pusher is moved toward the stationary wedge by the piston. Crowley, Jr.'s splitting attachment is complicated by the need to secure both a splitting wedge and pusher device to the dipper stick and bucket pivot.

U.S. Pat. No. 5,144,995 issued to B. Pettersson entitled "Apparatus for Splitting Loose Objects such as Tree Trunks" discloses a vehicle-mounted log splitting apparatus for splitting large logs or tree trunks wherein the log is picked up around its trunk by a gripping member attached to the end of a boom, one end of the log is braced against the ground or other surface and a splitting blade is hydraulically forced into the other end.

U.S. Pat. No. 5,320,149 issued to A. N. Peterson et al. entitled "Boom Mounted Log Splitter", discloses another vehicle-mounted log splitter boom attachment which is similar to the Pettersson splitter in that a log to be cut is held around its trunk by a grapple and is then split by a blade which is forced into an end of the log. In addition, logs can be gripped laterally between a heel rack and blade by pivoting such implements towards each other.

U.S. Pat. No. 5,803,141 issued to T. R. Patterson entitled "Combination Wood Splitter and Loader", discloses another hydraulic wood splitting attachment to be secured to a vehicle, although it is not necessarily designed to be used with material moving vehicles such as a backhoe. In one embodiment, a log is held on its ends and continued inward force or movement causes the log to be split into two parts.

U.S. Pat. No. 6,609,547 issued to R. P. Machkovech entitled "Log Splitter Attachment for a Skid Loader", discloses a log splitter attachment for use with a skid loader including a mounting frame and a beam whereby similar to several previously described arrangements a piston is used to force a log against a wedge with a sufficient force to split the log.

U.S. Pat. No. 6,763,864 issued to W. Setlack et al. entitled "Log Splitter Attachment" discloses a log splitting attachment for use with a loader whereby a frame supporting a blade and log pusher is secured to the loader lift arms in place of a bucket, and wherein the pusher is moved by an actuator toward the blade to split a log.

U.S. Pat. Pub. No. 2009/0236011 issued to S. D. Bolton entitled "Hands Free Wood Splitter" discloses a log splitter attachment for a skid loader, farm tractor, backhoe, or other mobile vehicle with hydraulically movable arms including a spinning auger which is pressed downwardly into the log to split it.

U.S. Pat. Pub. No. 2009/0288737 issued to M. A. Gilmet entitled "Apparatus for Positioning and Splitting Wood", discloses another splitting apparatus for use with a backhoe in which a beam with a movable or stationary jaw member is secured to the bucket end of the backhoe boom, and logs are grasped and split between a movable jaw member and stationary jaw member.

A drawback of most known log splitter attachment devices is that they require either the operator or a separate worker to manually lift and load each log to be split into the splitting device. Thus, weaker individuals will quickly tire of manually lifting each log onto the splitting device, and in addition there is a danger of muscle pulls, logs slipping, and other devices that together present a significant safety hazard. Another drawback of existing log splitter attachments is that it is difficult to operate the attachment because the visibility of the operator is obscured by the attachment equipment. The Chapman (U.S. Pat. No. 4,600,043) splitter attachment includes a pair of claws that can be used to lift and move logs to be split without requiring manual movement. However, this still requires a separate lifting and moving operation and then cutting operation, which is both time-consuming and inefficient. The Crowley (U.S. Pat. No. 4,615,367) splitter attachment apparently can be used to pick up logs to be split, but requires both a separate wedge and pusher member, rather than utilizing an existing thumb member. In addition, known splitter attachments are inflexible in that they are not adapted to be secured either directly to a backhoe dipper stick or using a quick-connect mechanism, and furthermore do not take full advantage of existing attachment devices which can be used in combination with the splitter attachment. The present inventor has therefore conceived of a log splitting attachment tool or device for use in combination with a material moving machine such as a backhoe that does not require manual loading of logs on the splitting device, and that minimizes the number of special parts that must be purchased to utilize an existing machine such as a backhoe as a log splitter. In addition, the present inventor's splitting attachment device can be used with existing quick coupling bucket mounting mechanisms to more quickly engage and disengage a bucket or other attachments to a backhoe dipper stick.

OBJECTS OF THE INVENTION

It is therefore an object of the present invention to provide a log splitter attachment tool or device for use in combination with material moving machines such as a backhoe that can be easily engaged and disengaged from such machine.

It is a further object of the invention to provide a log splitter attachment device for use with a backhoe that is engaged with the backhoe dipper stick and hydraulic system in place of a conventional bucket or other attachment so that the backhoe hydraulic controls are operated to move a piston and activate the splitting device.

It is a further object of the invention to provide a log splitter attachment device and method of use in combination with a mobile machine such as a backhoe that requires a minimum number of additional working parts and whereby the backhoe can be utilized both to pick up and move and then to split logs while minimizing the amount of manual labor required to operate and load the splitter.

It is a still further object of the invention to provide a log splitter attachment device that is designed for use with either a backhoe quick-connect mechanism or to be connected directly to a backhoe dipper stick and piston rod of the backhoe bucket hydraulic cylinder.

It is a still further object of the invention to provide a log splitter attachment device and method of use whereby the attachment device is operably secured to the end of the dipper stick and to the bucket hydraulic cylinder, and whereby logs to be split are held between the blade section of the attachment device on one end and an opposing claw or thumb tool or accessory separately secured to the dipper stick.

It is a still further object of the invention to provide an apparatus for splitting logs using a mobile machine such as a backhoe having an attached claw or thumb tool accessory, and in addition including a gripping plate member which is secured over the fingers of the claw or thumb tool to facilitate holding a log on one end during splitting operations.

Still further objects and advantages of the invention will become evident by reference to the following description and appended drawing figures.

BRIEF SUMMARY OF THE INVENTION

The present invention is a log splitter tool attachment or mechanism as an accessory to be used with mobile machines having an articulating boom and dipper stick such as a backhoe, which tool can be operably connected either directly to the dipper stick and hydraulic cylinder used to pivot the bucket, or to a quick coupler mechanism used to more quickly and easily engage and disengage a bucket as well as other attachments to the dipper stick and bucket cylinder. The log splitter attachment includes a body section adapted for operably connecting the attachment either directly to the dipper stick or indirectly via a quick coupler mechanism, and a blade section including a cutting or splitting blade which when the tool is secured to the backhoe is facing inwardly with respect to the dipper stick. The blade is also spaced apart and aligned with a stationary thumb or jaw member or accessory secured extending downwardly from the inner side of the dipper stick opposite the blade, which in one embodiment includes a plurality of log engaging knobs or fingers. An operator utilizing the machine controls can operate the boom and dipper stick having the log splitting attachment device of the present invention thereon to pick up and move a log to a desired cutting or stacking location, holding it around the trunk between the thumb and attachment. The log is released and then picked up again on its ends, with one end of the log pressing against the stationary thumb member and with the blade section of the attachment engaging the opposite end of the log. The bucket hydraulic cylinder is then operated to force the blade inwardly on the end of the log, causing it to spread and eventually split into two separate pieces. A cover plate which is secured over the spaced apart fingers of the thumb or jaw member is also provided to aid in holding logs to be cut and further to prevent smaller diameter logs from slipping between such fingers during cutting operations.

BRIEF DESCRIPTION OF THE DRAWINGS

The present invention will become more fully understood from the detailed description and the accompanying drawings, wherein.

DESCRIPTION OF THE PREFERRED EMBODIMENTS

The following detailed description is of the best mode or modes of the invention presently contemplated. Such description although detailed and exact to enable those skilled in the art to practice the invention, and by reference to which in connection with the following description and the accompanying drawings one skilled in the art may be advised of the advantages and construction of the invention, is not intended to be understood in a limiting sense, but merely to exemplify the invention, which may be embodied in other specific structure.

Figure 1:
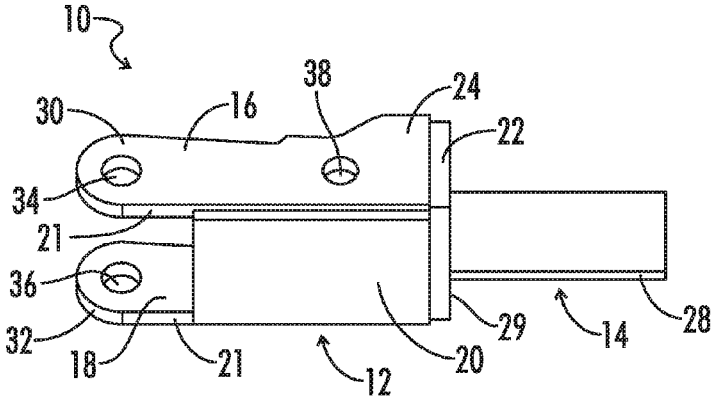
FIG. 1 is a perspective view of a first side of the log splitter attachment tool of the present invention.
Figure 2:
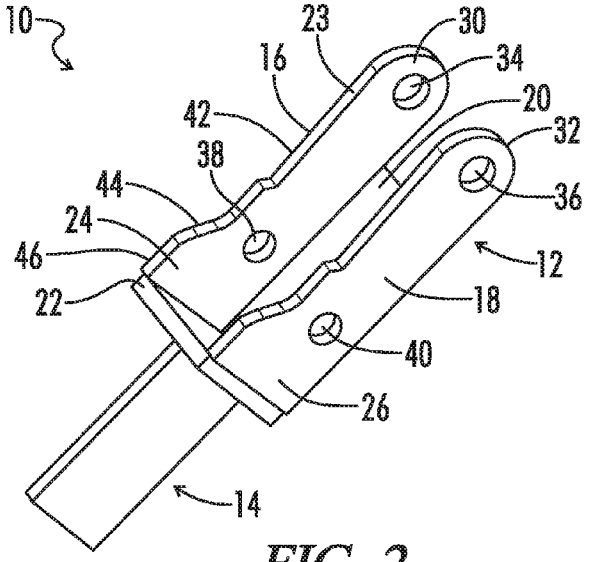
FIG. 2 is perspective view of the opposite side of the log splitter attachment tool shown in FIG. 1.
Figure 3:
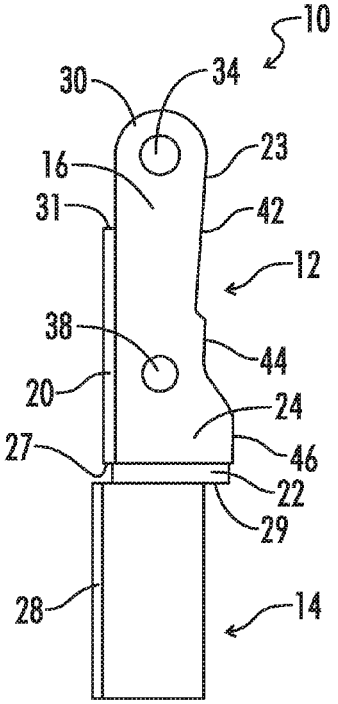
FIG. 3 is an elevation view from the side of the log splitter attachment tool of the present invention.

The log splitting attachment tool or apparatus 10 of the present invention is adapted to be removably secured either directly or indirectly via a quick connect attachment mechanism to the dipper stick of a construction or material moving earthworking machine such as a backhoe machine, having an articulating boom and dipper stick. One such backhoe loader machine available is the 310SE John Deere 4045T Backhoe Loader manufactured by John Deere, Inc. of Moline, Ill. As shown in FIGS. 1-3, splitter attachment tool 10, which is preferably made entirely of steel, generally is comprised of a body section 12 and a blade section 14. Body section 12 includes a pair of elongated spaced apart parallel plates 16 and 18, which are connected preferably by welding to a connecting plate member 20 which extends perpendicularly between such plates and is secured lying flat across first edge surfaces 21 of the plates. In addition, a second flat end plate member 22 is secured by welding to ends 24 and 26 of plates 16 and 18, respectively, and end 27 of connecting plate 20.

Blade section 14 includes an elongated blade or cutting edge 28 and is secured also preferably by welding to plate 22 extending generally outwardly and perpendicularly from the outer surface 29 of plate 22. Blade or cutting edge 28 preferably has a V-shaped tip and, as best illustrated in FIG. 3, blade or cutting edge 28 is oriented on the same side of attachment tool 10 as connecting plate 20 secured to plates 16-18. In the exemplary embodiment, blade section 14 is also slightly offset on the outer surface 29 of plate 22 so that blade edge 28 protrudes outwardly slightly beyond the outer surface of plate member 20.

Ends 30 and 32 of parallel plates 16 and 18 opposite blade section 14 are rounded, and aligned apertures 34 and 36 are provided on such ends, forming a yoke. End 31 of connecting plate 20 is spaced from ends 30 and 32 so that the yoke extends outwardly from connecting plate 20. A second set of aligned apertures 38 and 40 is provided in parallel plates 16 and 18 nearer to ends 24 and 26, respectively. The second side surfaces 23 of parallel plates 16 and 18 each have a flat section 42, followed by a first wider stepped section 44, and a second wider stepped section 46. The position of pairs of apertures 34-36 and 38-40 as described below with particular reference to FIGS. 4-6 as well as the width of parallel plates 16 and 18 and overall design enable the log splitting attachment tool 10 to be easily engaged and disengaged either directly with the dipper stick and hydraulic system of a backhoe machine or via an intermediate quick connect or coupling mechanism.

Figure 4:
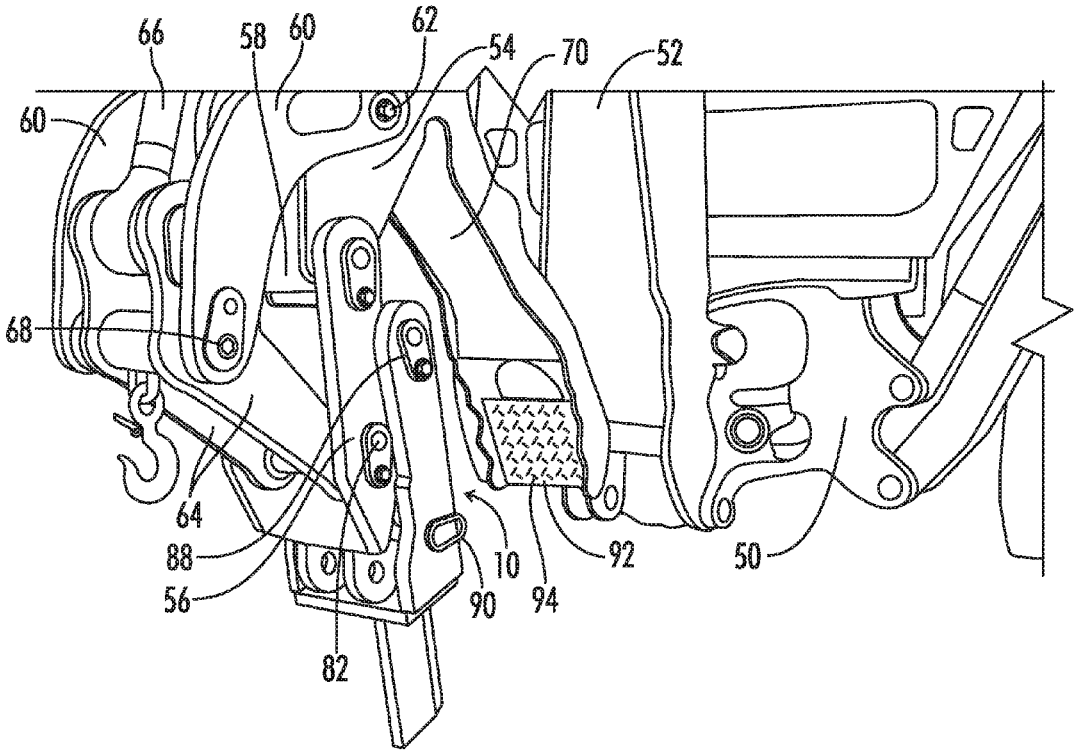
FIG. 4 illustrates the log splitter attachment tool from the front secured to a quick coupling mechanism and backhoe dipper stick.

The interoperability of the components of a backhoe machine and log splitting attachment tool 10 will now be described in greater detail. FIG. 4 illustrates a backhoe 50 having a boom 52 to which an extensible dipper stick 54 is pivotably connected in a conventional manner. In addition, a prior art quick coupling mechanism 56 is secured to the end of dipper stick 54, and the log splitting attachment 10 of the present invention is secured to the backhoe dipper stick 54 via quick coupling mechanism 56. It will be understood that different types of quick coupling mechanisms are known and may be utilized depending upon the backhoe or other material moving machine type and manufacturer, and that the specific features of the log splitter attachment tool 10 described herein may be adapted for use with any of such other coupling mechanisms, all of which generally include a bucket mounting linkage and hydraulics. The free end of dipper stick 54 is rounded and includes aligned apertures, forming a yoke 58. Angled links 60 are pivotally secured on their distal end to dipper stick 54 by pin 62, while straight links 64 and the bucket hydraulic piston 66 (preferably via another short link) are both secured to the proximal end of angled links 60 by pin 68. In addition, jaw or thumb member 70 is rigidly secured extending downwardly from the underside of dipper stick 54 by pin 72, and by another link 74 connecting between pin 76 on thumb 70 and pin 78 on dipper stick 54 (see FIGS. 5 and 7).

Figure 5:
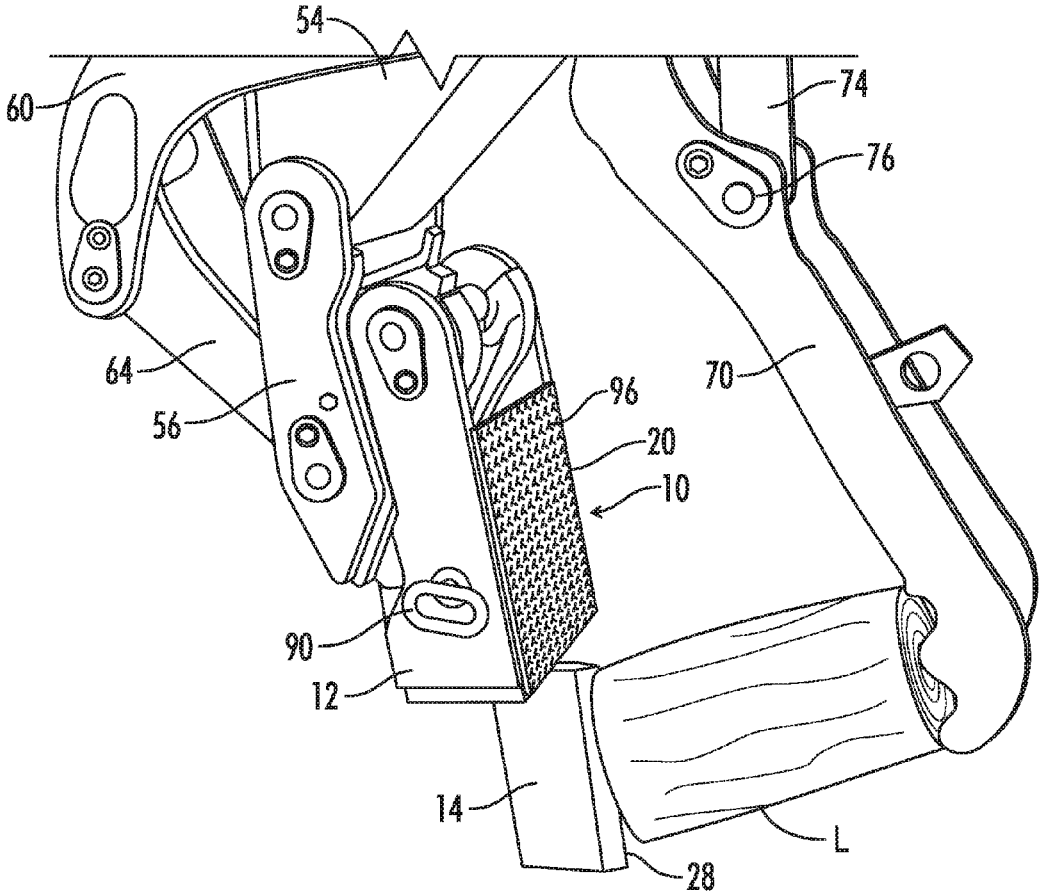
FIG. 5 illustrates the log splitter attachment device secured to a backhoe dipper stick from the side.
Figure 6:
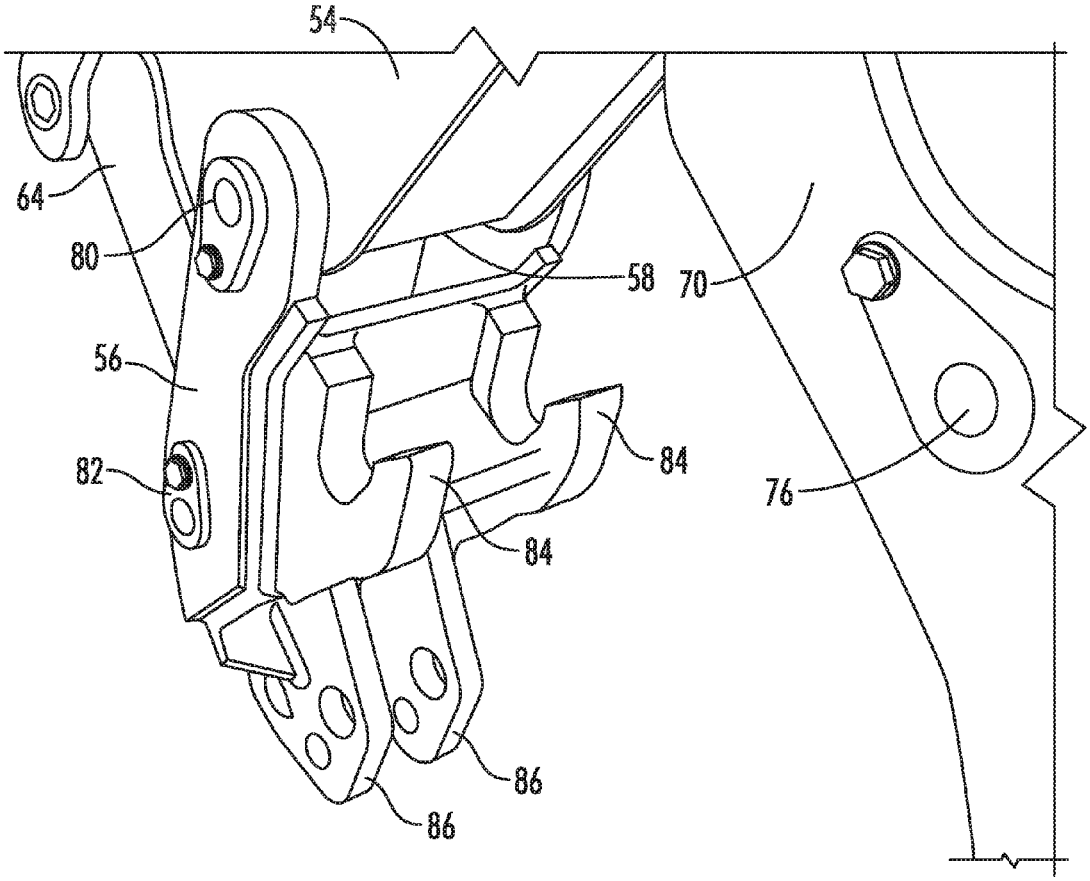
FIG. 6 illustrates a prior art quick coupling mechanism.
Figure 7:
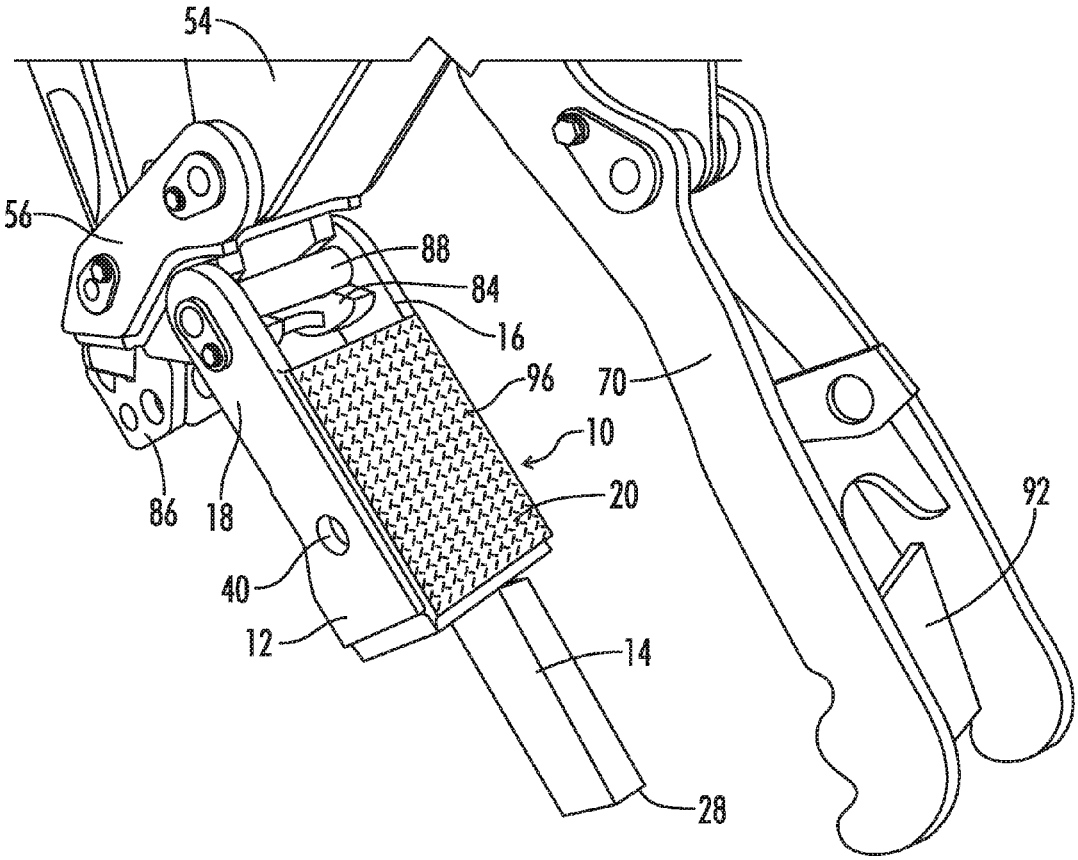
FIG. 7 illustrates the manner of attachment of the log splitting attachment tool or apparatus of the present invention to the quick coupling mechanism shown in FIG. 6.

Quick coupling mechanism 56, which is best shown in FIG. 6, is secured to yoke 58 on dipper stick 54 by pin 80, and in addition to the free end of straight links 64 by pin 82 (see also FIG. 4). Quick coupling mechanism 56 also includes a pair of bucket mounting hooks 84, and a yoke 86 through which as described below a pin is inserted to operatively connect a backhoe accessory such as a conventional bucket to dipper stick 54 and bucket hydraulic piston member 66. As shown in FIG. 7, log splitting attachment tool 10 is secured to quick coupling mechanism 56 by inserting a pin 88 through apertures 34 and 36 in plates 16 and 18, which pin 88 is also secured over mounting hooks 84. In addition, apertures 38 and 40 of log splitting attachment 10 are aligned with one of the sets of apertures on yoke 86 of coupling mechanism 56, and as shown in FIGS. 4-5 a pin 90 is passed through such aligned apertures in order to rigidly secure log splitter attachment 10 to coupling mechanism 56. When fully secured to quick coupling mechanism 56, the outer surface of connecting plate 20 is facing away from mechanism 56 towards boom 52 and opposed jaw member or thumb 70, and blade edge 28 of blade section 14 is aligned with and generally facing towards opposed jaw member or thumb 70, although the exact angle of blade edge 28 with respect to thumb 70 depends on how far the bucket cylinder is extended. As best shown in FIGS. 4 and 5, plates 16 and 18 of body section 12 of log splitting attachment 10 are spaced apart a sufficient distance so that both mounting hooks 84 and yoke 86 of quick coupling mechanism 56 are able to slide or fit snugly in-between plates 16 and 18. In addition, plates 16 and 18 near ends 24 and 26 (see FIG. 2) and in particular stepped sections 42, 44, and 46 of second side surfaces 23, are contoured to avoid any impingement with the links of quick coupling mechanism 56 to dipper stick 54 and links 64.

In use, a log or tree to be further split may first be lifted and moved using the device of the present invention by operating the backhoe controls to grasp such log around its trunk or circumference between log splitting attachment 10 and thumb member 70, and then moving or carrying the log to a suitable splitting location, such as adjacent a wood pile or the like. If necessary, the trunks are cut using a chain saw or the like to a proper cutting length. Then, as shown in FIG. 7 the backhoe is maneuvered to pick up a log L to be split and lying on the ground so the log is positioned and being held lengthwise between thumb member 70 and blade member 14 of log splitting attachment tool 10, with one end of the log centered against thumb member 70. The backhoe is then operated to force blade member 14 against the opposite end of the log L, with the bucket hydraulic cylinder being operated to force the blade inwardly on the end of the log, causing it to spread and eventually split into two separate pieces. Logs can also be lifted off of the ground and then moved over a wood pile or the like so the split logs are added to the pile without requiring further manual stacking or the like. In addition, thumb member 70 can be pivoted on dipper stick 54 to adjust the distance between such thumb member 70 and cutting blade 28. Thus, in the illustrated embodiment the log splitting attachment 10 can be used to split logs of different lengths ranging generally between approximately two foot sections for logs to be placed in a conventional fireplace or the like, and approximately four foot sections for logs to be used in outdoor boilers or other types of boilers that can accommodate such longer logs. Depending upon the intended use of the split logs, the amount of work required may be reduced where longer logs are suitable.

It should be evident in view of the above description that a significant advantage of the present invention over prior art log splitting attachment arrangements is that by minimizing the number of special parts and attachments that are required, the present inventor's log splitting attachment tool device or accessory can be set up and used more easily and quickly than other known backhoe log splitter attachments, and the basic manner of use can therefore be quickly understood even by novice backhoe operators. In addition, the operator's vision or view of the splitting operation from the backhoe cab utilizing the combination of the present inventor's attachment tool and a thumb member is not obscured by any such additional bulky and complicated special parts and attachments, which even further increases the safety and ease of use of the log splitting attachment, as well as the overall speed of such operation. Since logs to be cut can be both picked up and moved and then split using the same equipment, the result is an extremely efficient and affordable attachment tool in comparison to prior art log splitting arrangements, which mostly require individual manual loading of the splitter device, or obscure the machine operator's vision by providing a separate carrying frame or the like. Use in combination with an existing thumb member also saves a significant amount of expense.

While as described above the log splitting attachment tool 10 of the present invention is secured to a backhoe dipper stick 54 via quick coupling mechanism 56, as indicated above another feature of such attachment tool 10 is that it has been constructed so that it can be secured directly to dipper stick 54 without requiring any additional parts. More particularly, to secure device 10 directly to dipper stick 54 pin 88 is secured through apertures 34 and 36 of plates 16 and 18 of attachment body member 12 as well as directly to yoke 58 of dipper stick 54, while pin 90 is secured through apertures 38 and 40 in plates 16 and 18, and to the ends of links 64, which are operably connected to bucket piston member 66. Such direct connection arrangement may be preferred if the backhoe is going to be used with log splitting attachment tool 10 for long periods so as to minimize wear on the quick coupling mechanism 56, or if the user does not own a quick coupling mechanism.

In addition, log splitting attachment tool 10 has been described with reference to use in combination with a standard jaw or thumb member 10 of a type which accessories are generally known for use with earthmoving machines and which are commercially available. It has been found, however, that some prior art thumb members, which include a pair of downwardly extending parallel fingers while suitable for holding logs having a diameter that is greater than the distance between the fingers, are less suited for holding smaller diameter or narrower logs, since the ends of the logs sometimes could slip between the fingers, particularly when tension is placed on the opposite end of such logs by blade member 14 during an attempted splitting operation. Thus, to address this possible problem, as shown in FIG. 4, the present inventor has provided a modified thumb member wherein a plate 92 is secured between such parallel and downwardly extending fingers by welding or the like, which aids in preventing logs from slipping between such fingers. Preferably, plate 92 will include a plurality of teeth 94 or other means on its contact surface with the end of a log to prevent such log from slipping. In another embodiment, the present inventor has provided a rigid cover member, preferably made of steel, that is adapted to be fitted and then secured such as by clamping over at least a portion of such parallel thumb fingers in order to accommodate for the space between such fingers and to serve as an improved support surface against which a log being held between thumb 70 and log splitter attachment tool 10 is held. Preferably, such a plate will be of simple design and will include a rectangular steel plate dimensioned to span across the fingers. In one embodiment, the side surfaces of the plate will include cutouts which aid in fitting the edges of the plate over the teeth on the fingers of the thumb member 70, while in another embodiment a pair of parallel plates may be secured to the rear surface of the cover plate and which are spaced apart so as to extend around the sides of the fingers, while a pin or the like may be secured extending between such plates over the rear side of the thumb member, thereby securing it in place in an easily disengageable manner. The front or forward facing surface of the plate member also preferably is provided with one or more tooth members or the like which will aid in holding a log against such surface.

In another adaptation, at least a portion of blade member 14 may be adapted to be detached from body section 12 of log splitting attachment 10, in which case different types of splitting blades or wedges could be interchangeably secured to body section 12, although due to the large forces exerted on the blade during log splitting permanent welding of blade member 14 to body section 12 is preferred. In addition, body section 12 may also be adapted or shaped for use in lifting and moving logs by their trunks by gripping them between the outer surface of cross plate 20 and thumb 70, in which case a plurality of tooth members or knobs 96 may be provided on such outer face in order to improve the grip on the log being moved. Once all the logs have been moved to a cutting position, blade member 14 would then be reattached to body member and utilized to split the logs in essentially the same manner as has already been described herein.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A log-splitter attachment tool adapted to be utilized with a mobile machine having a hydraulically articulating boom and dipper stick and an opposing thumb member secured to the dipper stick comprising:

(a) a body section, said body section releasably attached for pivotable movement to the dipper stick and hydraulic system of the machine or to a quick coupler mechanism attached to the dipper stick, said body section including a pair of parallel plates spaced apart so as to fit over an end of either said dipper stick or said quick-coupler mechanism, and (b) a blade section extending from the body section, said blade section including an elongated splitting blade, having a cutting edge, which when said tool is attached to the dipper stick aligned opposite said opposing thumb member, enabling a log positioned between the thumb member on one end and the splitting blade on the other end to be split by activating the controls of said hydraulic system to pivot the splitting blade towards the thumb member.

2. The log splitter attachment tool of claim 1 in which said parallel plates are connected by a first plate secured extending between a portion of one of the sides of said parallel plates.

3. The log splitter attachment tool of claim 2 additionally comprising a second plate secured extending between an end surface of said parallel plates generally perpendicular to said first plate.

4. The log splitter attachment tool of claim 3 in which said blade section is secured extending in the direction opposite said parallel plates from the outer surface of said second plate.

5. The log splitter attachment tool of claim 4 in which the cutting edge of the splitting blade of said blade section is aligned in the same direction with the outer surface of said first plate.

6. The log splitter attachment tool of claim 5 additionally comprising a plurality of tooth members on the outer surface of said first plate.

7. The log splitter attachment tool of claim 1 additionally comprising first and second pairs of apertures provided in said parallel plates which are positioned to be aligned with either a hook member and apertures in said quick connect mechanism or linkages on said dipper stick and bucket cylinder.

8. The log splitter attachment tool of claim 7 additionally comprising a rigid cover member which is removably secured between the downwardly extending fingers of said thumb member, and having a plurality of tooth members on the outwardly facing surface against which the end of a log to cut is aligned.

9. A log-splitter attachment tool comprising:

(a) a body section, said body section including a pair of spaced apart parallel plates having a first end, a second end, inner and outer side surfaces, and first and second edge surfaces, a connecting plate member extending between a portion of the first edges surfaces, and an end plate member secured to the first end of said parallel plates, (b) a first pair of aligned through-apertures in the parallel plates adjacent the second ends of the parallel plates, said second ends having a rounded outer surface and together forming a yoke, (c) a second pair of aligned through-apertures in the parallel plates spaced apart from said first pair of through-apertures, and (d) a blade section secured extending outwardly from said end plate member, said blade section including an elongated splitting blade, (e) said body section adapted to be operably secured to the dipper stick and bucket cylinder of a material moving machine.

10. The log-splitter attachment tool of claim 9 in which said tool is used in combination with a thumb member secured to said dipper stick and spaced apart from and aligned with said splitting blade.

11. The log-splitter attachment tool of claim 10 in which the body section of said log splitter attachment tool is securable to a quick connect mechanism of a backhoe.

12. A log-splitter attachment tool adapted to be utilized with a material moving machine having a hydraulically actuated articulating boom and dipper stick and an opposing thumb member secured to the dipper stick comprising:

(a) a body section, said body section including a pair of spaced apart parallel plates each having a first end, a second opposite end, inwardly and outwardly directed side surfaces, and first and second edge surfaces, a connecting plate extending between a portion of the first edges surfaces, and an end plate extending over the first end of said parallel plates, (b) a first pair of aligned through-apertures extending between the inwardly and outwardly directed side surfaces of the parallel plates and located in close proximity to the second ends of the parallel plates, said second ends having a rounded outer surface and together with said through-apertures forming a yoke, (c) a second pair of aligned through-apertures extending between the inwardly and outwardly directed side surfaces of the parallel plates spaced apart from said first pair of through-apertures, and (d) a blade section connected extending outwardly from said end plate and including an elongated splitting blade, (e) the yoke dimensioned such that when connected to the dipper stick and bucket cylinder or to a quick-coupling mechanism attached to the dipper stick by pins extending through the first and second pairs of aligned through-apertures, the parallel plates surround the dipper stick or the quick-coupling mechanism linkages.

13. The log splitter attachment tool of claim 12 in which the second edge surfaces of the parallel plates are contoured to avoid impingement with the quick-coupling mechanism linkages.

* * * * *